United States Patent [19]

Miller et al.

[11] 3,936,211

[45] Feb. 3, 1976

[54] DRAINAGE DITCH MULE

[75] Inventors: David J. Miller; Charles P. Miller, both of McHenry, Ill.

[73] Assignee: Miller Formless Co., Inc., McHenry, Ill.

[22] Filed: Apr. 14, 1975

[21] Appl. No.: 567,500

[52] U.S. Cl. ..... 404/104; 404/96

[51] Int. Cl.² ..... E01C 19/48

[58] Field of Search ..... 404/96, 98, 84, 104, 101, 404/105, 110

[56] References Cited

UNITED STATES PATENTS

| | | | |
|---|---|---|---|
| 2,094,974 | 10/1937 | Wood | 404/96 X |
| 2,539,063 | 1/1951 | Ekenstam | 404/98 X |
| 2,953,977 | 9/1960 | Warren | 404/110 |
| 3,015,261 | 1/1962 | MacDonald | 404/104 |
| 3,031,938 | 5/1962 | Bero | 404/104 |
| 3,130,654 | 4/1964 | Apel | 404/104 |
| 3,135,178 | 6/1964 | Guntert | 404/108 |
| 3,208,362 | 9/1965 | Sigmund | 404/98 |
| 3,292,511 | 12/1966 | Cheney | 404/98 X |
| 3,541,933 | 11/1970 | Carpenter | 404/98 |
| 3,710,695 | 1/1973 | Miller | 404/98 X |

*Primary Examiner*—Nile C. Byers
*Attorney, Agent, or Firm*—Bruce K. Thomas

[57] ABSTRACT

A slip form or mule for continuously laying concrete along the contoured side wall and top edge of a drainage ditch. The slip form is affixed to or pivotally mounted from the side of a construction machine that travels along the top side of the ditch. An integral open-bottomed sloping hopper feeds concrete to the slip form which has an adjustable top wall extension and an extendable end wall and sides that simultaneously adjust and are guided on the top slanted wall of the slip form to form a concrete slab of different widths. The frame also supports a trailing screed that is pivoted from and supported by one or more biased bell cranks and canted toward the slope of the ditch side. The hopper has a series of adjustable weirs and vibrating means to spread and consolidate the concrete before the front opening of the slip form. The top inside wall of the slip form and back bottom wall of the hopper may also be pivoted about a longitudinal axis to maintain the inside wall of the slab vertical as the height of the slip form is varied.

10 Claims, 12 Drawing Figures

DRAINAGE DITCH MULE

BACKGROUND OF THE INVENTION

It is known in the art to line canals and ditches with concrete, using a front bulkhead and a rear troweling skirt which is moved longitudinally along the excavation as the machine progresses and as concrete is poured between the bulkhead and the skirt. Concrete is supplied by a traversing conveyor which moves across the machine from a supply. The concrete pours down through a plurality of treemie tubes upon the graded surface. A single cross conveyor or a skip car can also be used to transfer concrete from the supply to the opposite sides of the slip form. Various forms of concrete consolidating structures are disclosed in the art including a forward bulkhead which is mounted on an eccentric to provide oscillation and thus compaction of the concrete to the desired degree. These tools are suspended from a frame that extends across the canal and is supported by endless tracks at each end that run along the top of the canal banks.

These machines provide limited adjustment for various sizes of canals or ditches and include adjusting means that operate vertically to vary the depth of the slab. Some systems employ a continuously moving screed or traveling pan to smooth the concrete to the desired surface configuration which tools are carried on an endless chain between a pair of transversely spaced sprockets. Those machines which provide vertical adjustment of the screed and trowel depend on complicated linkages, usually of the parallelogram and articulated frame configurations to provide this function. Machines of this nature are custom made for canal and ditch work where large spans are required and there is little or no variation in the contour of the graded ditch.

SUMMARY OF THE INVENTION

In accordance with this invention the problem of accurately and rapidly laying a conforming layer of concrete over a contoured sloping surface such as a drainage ditch is overcome. A combined spreading hopper and slip form is suspended from the side of a construction machine, having finite grade and slope control, whereby the machine can run on a substantially level surface and deposit the continuous contoured slab of concrete therealong. The rear wall of the open-bottomed contoured hopper is vertically off-set and extended to the rear to form the slip form of like contour. These parts are adjustably disposed above the side of the graded drainage ditch. The hopper has an adjustable end wall as well as well as adjustable upright spaced weir plates to define transverse compaction zones therein. The end wall of the hopper is carried by a sliding plate which rests upon the top of the slip form in guided relationship. A pair of extensible members operating in unison move the hopper end wall and the sliding plate laterally to accommodate changes in the width of the ditch side wall. The trailing screed pivots transversely and adjusts laterally to smooth the slab at the off set created by the extension of the sliding plate over the edge of the slip form. This member is canted to move the concrete laterally up the slope of the ditch side wall. The rear edge of the slip form and the front edge of the trailing screed have upturned, converging spaced walls and being offset, the latter supplies any excess concrete to fill the offset.

The instant invention provides a tool that can be used with a smaller transport carriage, such as an ordinary curb and gutter machine and is capable of successfully applying a continuous concrete slab along the top edge and sloping sides of the graded ditch. Means are provided to adjust the width of the sloping wall, the depth of the slab and insure even slab thickness regardless of irregularities in the graded surfaces. The tool of this machine attaches to the side of the transport carriage and under a side frame extension thereof in such a manner as to be in full view of the operator of the machine. Any differences in the width of the sloping wall are immediately compensated for by the adjustable hopper which carries with it an adjustable sliding plate that slides on top of the main fixed screed. The main screed may be relatively fixed and manually adjusted or automatically adjusted by a pair of longitudinally spaced extensible members attached between the side frame extension and the top of the main screed plate. Provision is made for coplanar reciprocation of the adjustable screed plate and the trailing edge of the finishing screed, which automatically compensates for and functions to smooth out the offset in the concrete slab along its bottom ragged edge.

DESCRIPTION OF THE DRAWINGS

Illustrative embodiments of the invention are shown in the drawings wherein.

DESCRIPTION OF THE PREFERRED EMBODIMENTS

Figure 1:
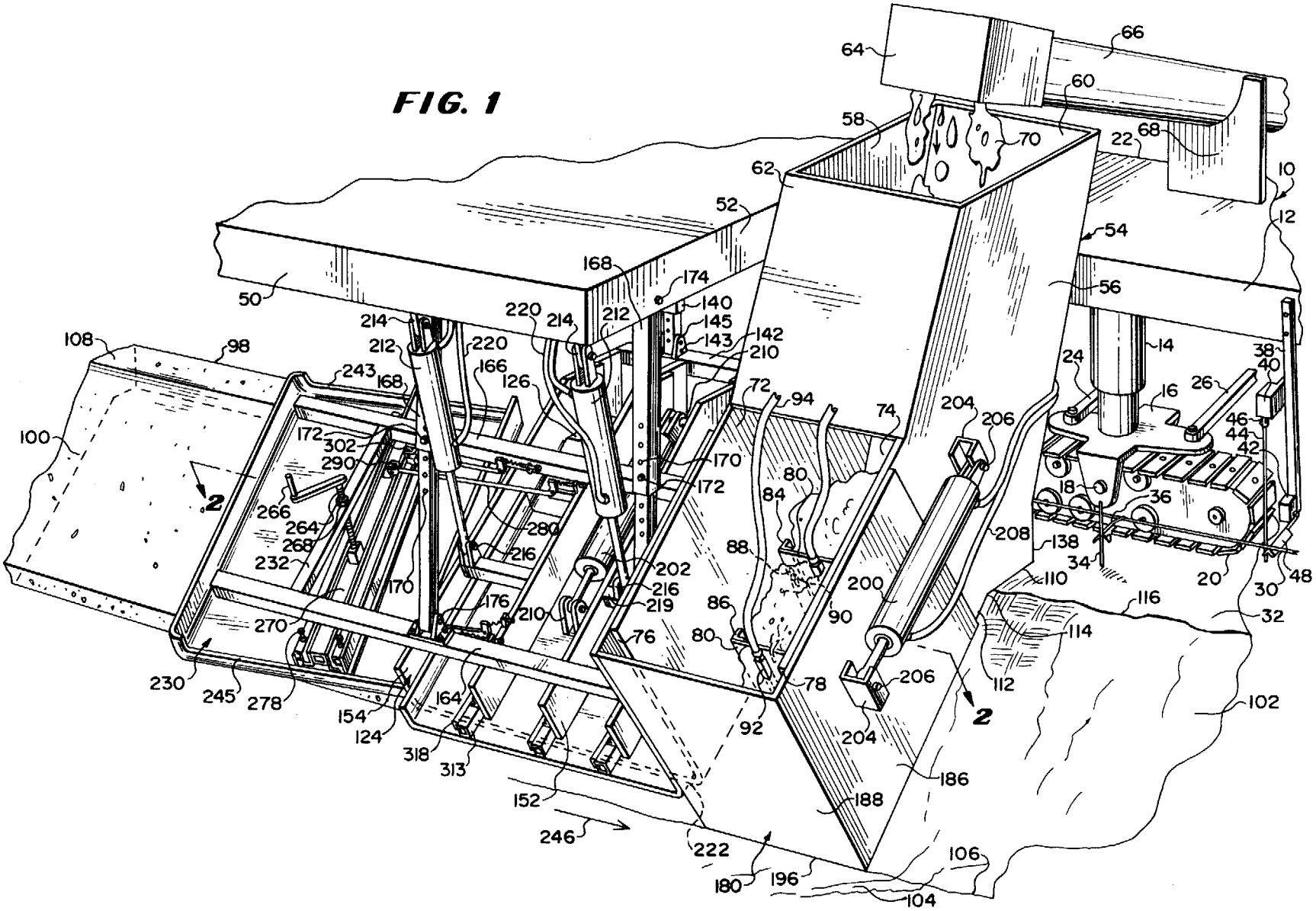
FIG. 1 is a fragmentary side elevation of the drainage ditch slip form of this invention shown attached to side of a curb and gutter machine.

Referring to the drawings, particularly FIG. 1, initially, a portion of the curb and gutter machine 10 is shown to include its main frame 12, one of the vertically adjustable support member 14 affixed to the saddle mount 16 which is pivotally mounted by means of the pin 18 to the endless track unit 20.

This machine may be of the type described in our U.S. Pat. Nos. 3,606,827 and 3,710,695 wherein the frame is supported on a five-point suspension, one represented by the support 14 of the endless track 20. A similar adjustable support and tractor combination for the inboard side of the machine is provided in tandem with the support 14 and tractor 20 at the rear of the frame 12. The outboard side, indicated at 22 is supported centrally by a transverse pivot and a single adjustable support means attached to a walking beam (not shown) that extends longitudinally at that side of the frame. Each end of the walking beam has a vertical steering pivot attached to the saddle mount of an endless track. An extensible member connects the midpoint of the frame on the outboard side to the pivot point on the walking beam midway between the pair of extensible members on the inboard side. The machine 10 is equipped with suitable pairs of linkages 24 and 26 spanning between the front saddles so that the front pair of tractors are steered in unison. The rear pair of tractors are similarly connected by steering linkages (not shown). The front pair of tractors steer independently of the rear pair in either direction and the tractors on each side are driven by suitable hydraulic motors (not shown) so as to drive the pair of tractors on the inboard side of the machine in unison and at the same or different speed from the pair of tractors on the outboard side, also driven in unison.

The machine follows the grade line 30 strung along the grade 32 and held by spaced stakes 34 and adjustable side arms 36 in a manner known in this art. The frame provides the support 38 for the steering sensor 40 and the grade sensor 42. The steering sensor 40 has the pendent swinging feeler arm 44 which touches the grade line 30 along one side under the resilience of the coil spring 46. The grade sensor 42 has the height detecting arm 48 riding on the underside of the grade line 30. A similar steering and grade sensor arrangement is used for the tandem inboard support and tractor at the rear of the machine.

The steering sensor is connected to a servo-hydraulic system operatively connected to a steering ram operating the linkages 24 and 26 in opposite directions so that the inboard front corner of the machine follows the grade line 30 exactly as the machine progresses. A similar steering sensor is provided at the rear of the machine to steer the rear pair of tractors and thus maintain the frame 12 substantially parallel with the grade line 30. On curves the side of the frame travels tangentially to an outside curve and subtends an inside curve.

The grade deviation sensor is connected to a servo-hydraulic system operating the extensible member 14, which has an internal ram whereby the frame 12 is always maintained at a predetermined height above the grade line 30 from the grade 32 and any deviations are corrected to close tolerances. The rear of the machine 20 will have its rear extensible support member under similar grade control.

The third extensible member on the walking beam is under the control of a gravity-actuated sensor which is connected through a servo-hydraulic system adopted to raise and lower the outboard side of the machine and maintain the desired cross slope constant. These grade, slope and steering control functions for the machine 10 are described in said patents.

Thus, the machine 10 is capable of traversing the grade 32 and maintaining the frame 12 in a predetermined level or slope position and at a constant or predetermined height from the grade 32 under the control of the grade and steering reference 30.

The main frame 12 has the inboard side extension 50 with the offset front side edge 52. The hopper 54 is defined by the front and rear walls 56 and 58 and the inside and outside walls 60 and 62 having an open top under the delivery end 64 of the conveyor chute 66 supported by the bracket 68. The conveyor is pivotally mounted so that it can be raised from its resting position on the bracket 68 and has an internal auger that delivers a continuous stream of concrete 70 into the open top of the hopper 54. The other end of the conveyor 16 and its auger is in communication with a receiving hopper (not shown) on the other front corner of the machine, positioned so as to receive the concrete 70 from concrete trucks.

The spaced side walls 56 and 58 have the parallel angled extension walls 72 and 74 whose outer edges 76 and 78 are straight and terminate in substantially parallel relationship. These extension side walls 72 and 74 function as guide and stop members, as will be described and can be any desired length which establishes the width of the narrowest side wall for a ditch to be formed.

Figure 2:
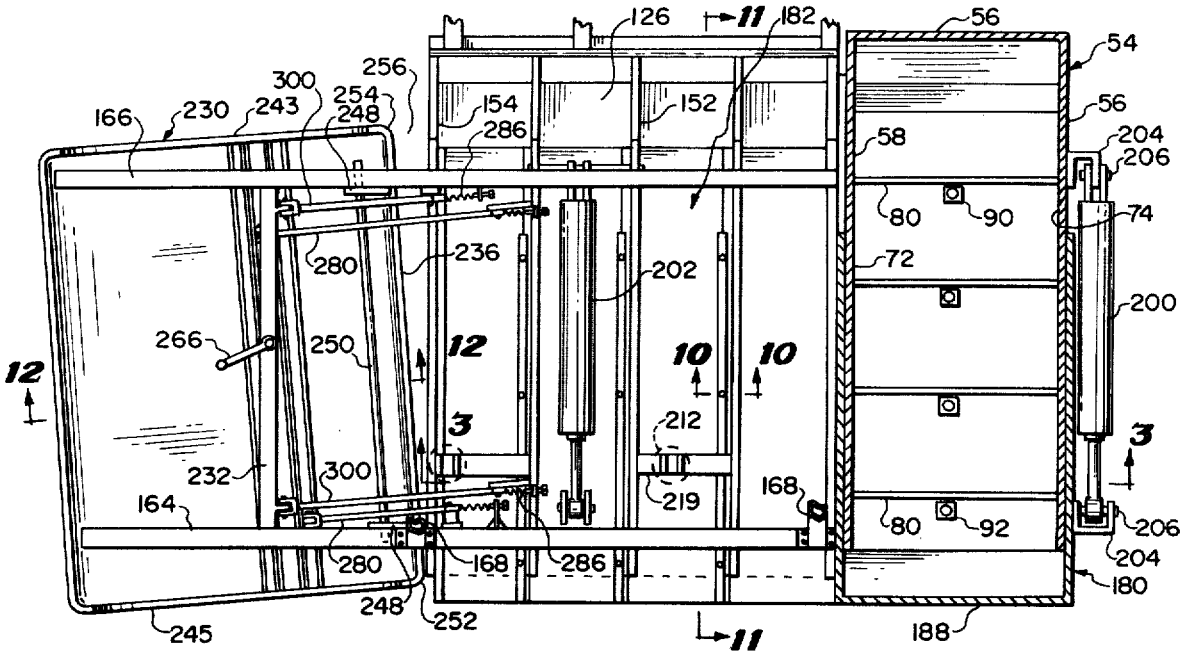
FIG. 2 is an elevational view of the hopper-slip form combination taken along the lines 2—2 of FIG. 1 with the hopper walls in section.

A series of spaced weir plates illustrated at 80 is provided within the hopper each extending transversely across the walls 72 and 74. These weir places are adjustably supported as by means of the L-shaped brackets 84 and 86. (FIG. 1) affixed to the side walls along each end edge of the plates. The plates are slotted at 88 and carry through-bolts 90 which upon loosening allow the plates to be moved up or down. FIG. 2 shows the use of four weir plates within the hopper 54. One or more vibrators 92 is attached to the front side of each weir plate and the electrical and/or mechanical connections for same are illustrated by the conduit 94. Other means to adjustably attach the weir plates may be used. The weir plates may also be pivotally mounted on a longitudinal axis between the side walls 72 and 74 to change their vertical orientation with respect to the level of concrete therein. The walls 60 and 62 slope outwardly from the machine and the former terminates at the bottom edge 96 (see FIG. 4) along the hinge line 97 so that the top inner edge 98 (FIGS. 1 and 11) of the concrete layer 100 can be maintained vertical as the other parts of the tool are adjusted.

The extension 50 of the main frame as well as the side walls 72 and 74 extend from the side of the machine over the graded wall 102 of the ditch to be paved. The bottom 104 of the ditch is generally flat. The rough juncture of the graded side wall 102 therewith is indicated at 106 and represents in general the line along which the extensible portions of the tools, to be described, are held, since the objective is to lay the slab of concrete 100 thereover having an integral birm cover or curb 108 joining with the top inner edge. The bottom 104 is separately paved with a continuous slab after both graded side walls 102 of the ditch are completed.

To accomplish these purposes the front lower edge portion 110 of the hopper wall 56 is fabricated so as to be generally parallel with the flat grade 32 on which the machine travels, while the edge 112 of the front extension wall 74 is contoured to lie generally along and just above the graded side wall 102. The lower edge 112 of the extension wall 74 joins the edge 110 at the corner 114 which is generally aligned along the top corner 116 of the graded ditch.

Figure 4:
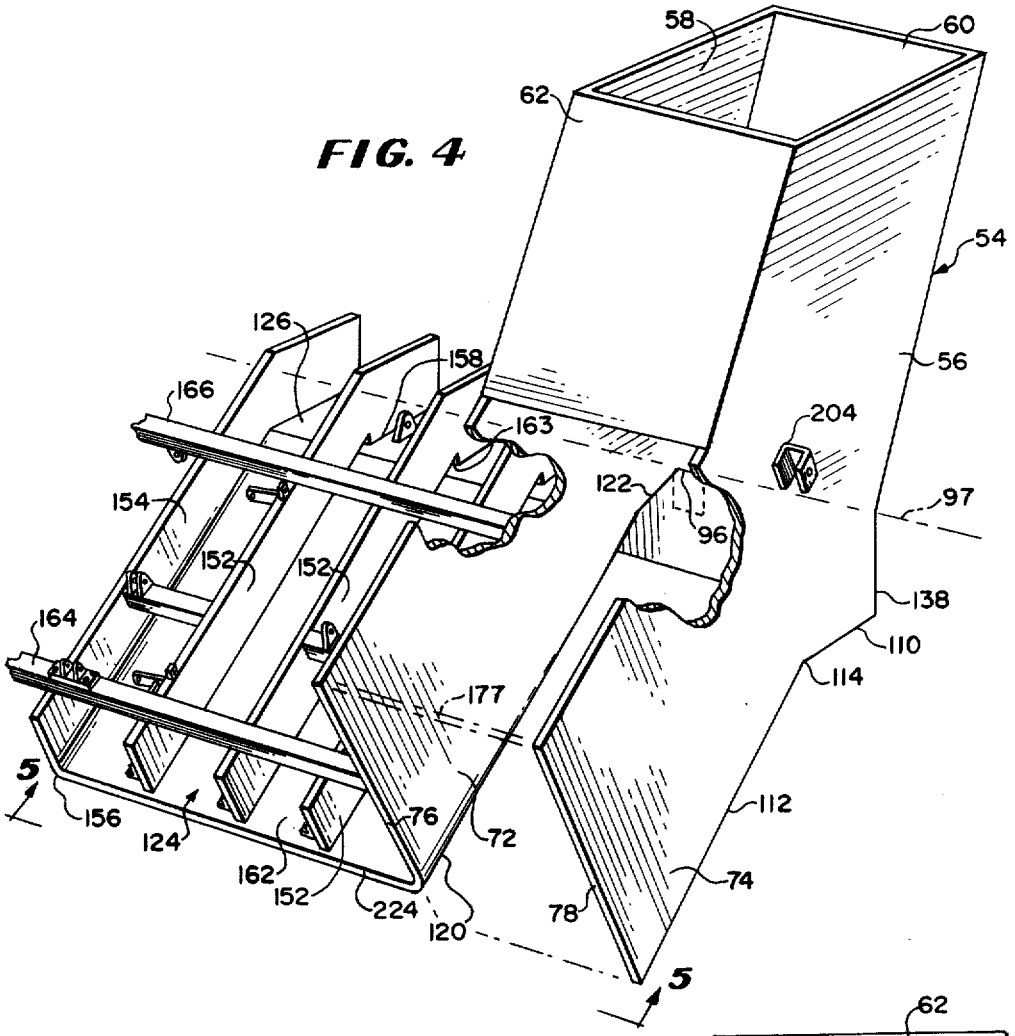
FIG. 4 is an elevational view of the main slip form and hopper side wall combination partially cut away to show the relationship of the parts.
Figure 5:
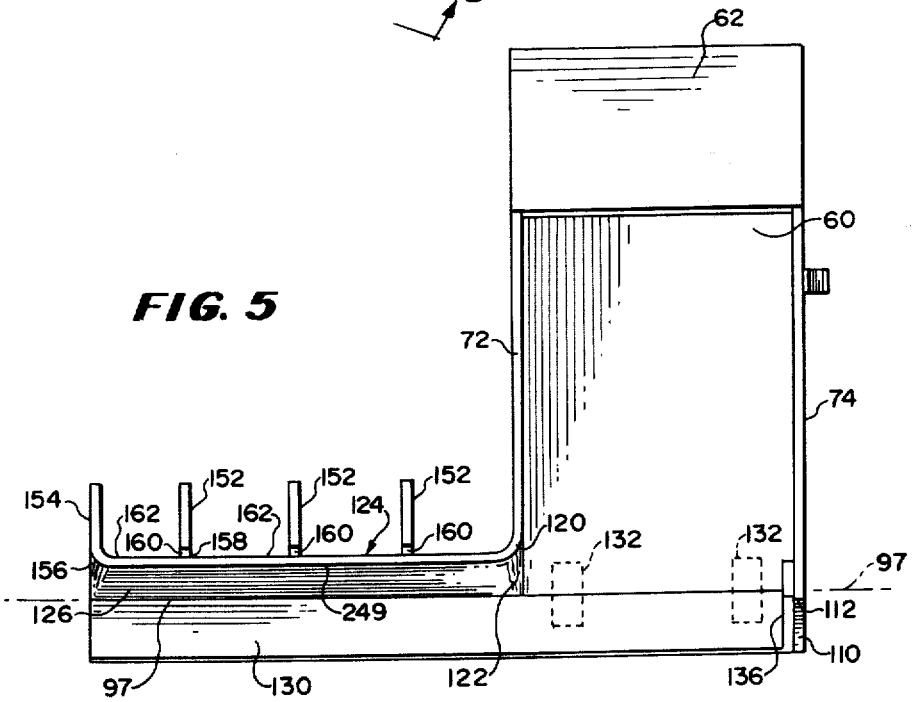
FIG. 5 is a side view taken along the plane of the lines 5—5 of FIG. 4.

Referring more particularly to FIGS. 4 and 5, the side wall 72 has the rounded bottom corner 120 that is generally parallel to but in a plane above the bottom edge 112 of the side wall 74 and rounded bottom corner 122 (FIG. 5) that are generally parallel to, but elevated above the bottom edge 110 of the wall 74. The wall 72 is joined and integral with the slip form 124 having the top wall 126 the back edge of which joins the hinge line 97. Accordingly, as the tool is carried along the preformed ditch the concrete 70, fed by the hopper 54 is spread between the walls 72 and 74 and passes under the edge 120 (see FIG. 5) into the form of the layer 100.

Figure 7:
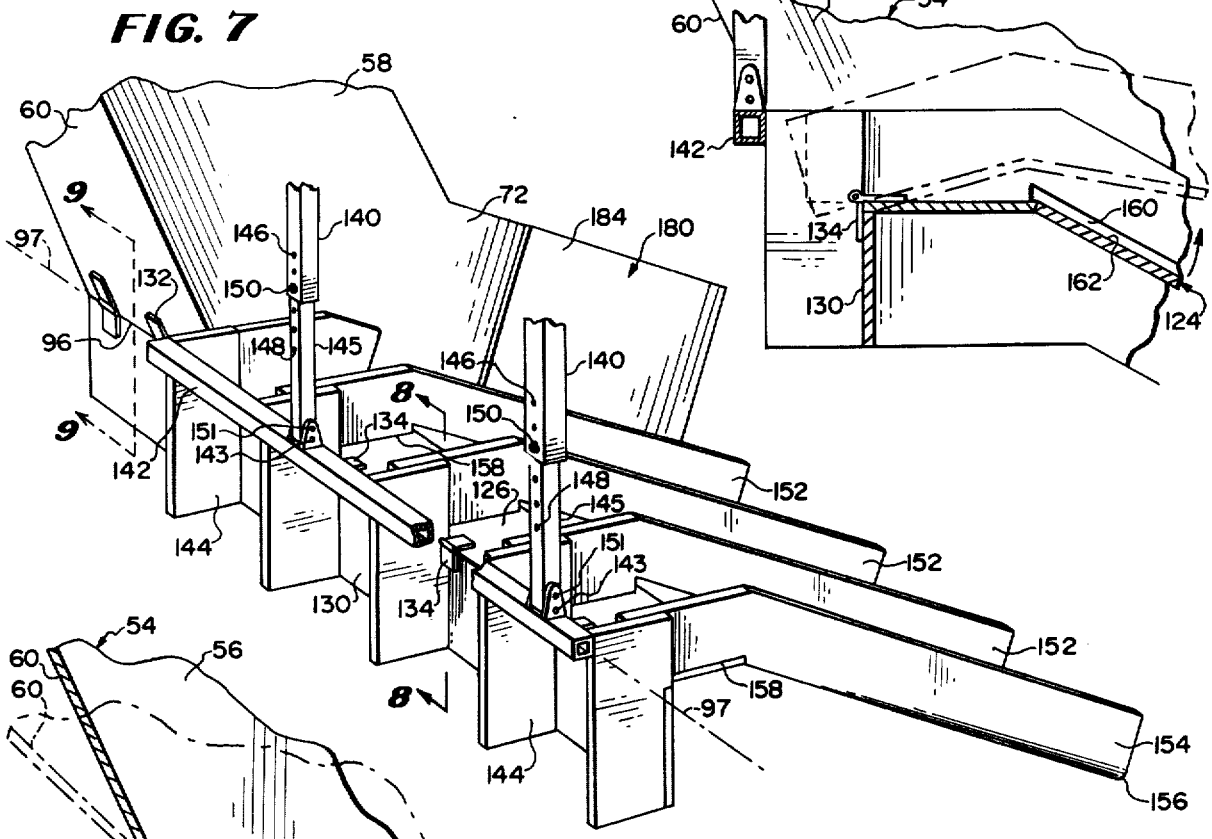
FIG. 7 is a fragmentary perspective view of the inner side of the slip form with the trailing screed detached.
Figure 8:
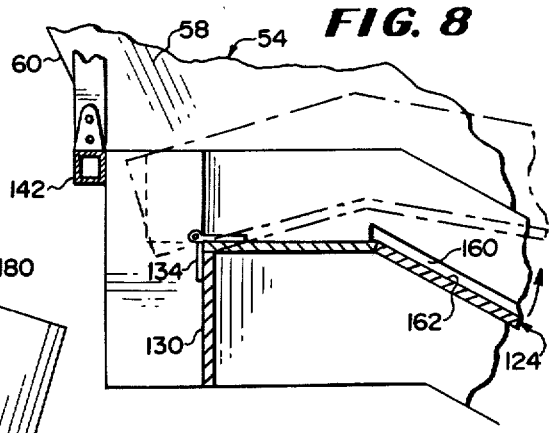
FIG. 8 is a fragmentary cross-sectional view taken along the lines 8—8 of FIG. 7.
Figure 9:
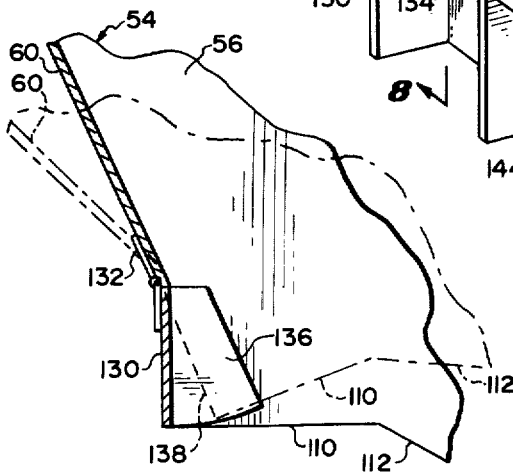
FIG. 9 is a fragmentary cross-sectional view taken along the lines 9—9 of FIG. 7 showing the longitudinal pivot action of the slip form and hopper.

Referring to FIGS. 7 and 8, the further relationship of these parts is shown to include the side moldboard 130 which is hinged along the hinge line 97 by means of a series of hinges 132 at the wall 60 and the hinges 134 at the top wall 126. In order that the rotation of the hopper 54 and the slip form 124 in relation to the frame 12 and its extension 50 along the hinge line 97 at the hinges 132 and 134 does not produce an opening at the front corner of the hopper from which concrete can spill out, the side moldboard 130 carries the plate 136 (FIG. 9) at the inside corner to close the gap between the edge 138 of the side wall 56. This arrangement is used, rather than extending the edge 138 over the front end of the side moldboard 130 to avoid any protuberances that would interfere with string line 30 or the stakes 34. The broken lines show the position of the hopper and slip form parts in relation to the moldboard 130 during such an adjustment. There is little if any tendency for the concrete to spill out under those edges as the machine is progressing.

The slip form 124 and the hopper 54 are supported from the frame extension 50 along its inboard side by the pair of longitudinally spaced upright rigid members 140 affixed to the longitudinal member 142 at their lower ends at the pivots 143. The member 142 is tied in turn to the series of reinforcing plates 144 spaced along and suitably affixed to the back side of the moldboard 130. This support means is made detachable and is provided with some degree of vertical adjustment by means of the telescoping form of the supports 140 employing the smaller telescoping portions 145 that slide within the supports 140 and having the spaced matching holes 146 and 148 to receive the through-bolts 150 at selected positions. In order to lock the pivots 143 and hold the moldboard 130 in place, the removable locking pins 151 are provided.

FIGS. 1, 4, 5 and 7 show that the slip form 124 includes a series of three guide plates 152 and an end plate 154, the latter joining and integral with the slip form 124 along the rounded corner 156. Each of these members is offset along the top wall 126 of the slip form and attached as by the weldments 158. The under sides of the guide plates 152 are cut out along their bottom edges to form the elongated slots 160 therealong and spaced above the plane of the top surface 162 of the slip form 124.

This assembly includes the spaced longitudinal beams 164 and 166 affixed by any suitable means to the top edges of the guide plates 152 and the end plate 154. The tie beam 164 has a second pair of upright rigid supports 168 (see FIGS. 1 and 11), like the supports 140, that also telescope and have the series of matching holes 170 and bolts 172 for this purpose. The supports 168 are pivotally mounted at the frame extension 52 by the pivot pins 174 and at the tie beam 164 by the pivoted mounts 176.

The weir plates 80 and 82 along with the vibrators 92 have been omitted from the embodiment shown in FIGS. 4 and 5. It is apparent that the combination of hopper 54 with or without the weir plates 80 and 82, can be provided with an end wall 177 (shown in broken lines in FIG. 4) across the edges 76 and 78 and the tool illustrated, supported by the pairs of uprights 140 and 168, can be used to lay the concrete layer 100. These supports can be readily adjusted by resting the tool on the grade, detaching the bolts 150 and 172, then lowering the machine 10 so that the supports telescope to a shorter length and the bolts re-attached. The machine can then be raised along with the tool by its extensible members 14, to approximate the required thickness of the concrete layer 100 and place the machine at a medium position of vertical adjustment.

In the event a further transverse change in the attitude of the tool is necessary, the outer supports 168 can be adjusted so that the tool hinges along the hinge line 97 to accommodate such change. In this embodiment the spacer plates 152 could also be omitted, or these members can be attached along their lengths to the top surface 162 of the slip form as reinforcing. The extensible supports 168 can be replaced with dual-action hydraulic rams connected to operate in unison to perform the support functions for the tool.

Since the specifications for a large share of the paving for drainage and irrigation ditches require rather close tolerances as to grade, slope and thickness, as well as a smooth finished surface and may include requirements for certain variations in depth and width along the ditch, this invention, in another embodiment, provides means to adjust the tool in conformance therewith.

Figure 3:
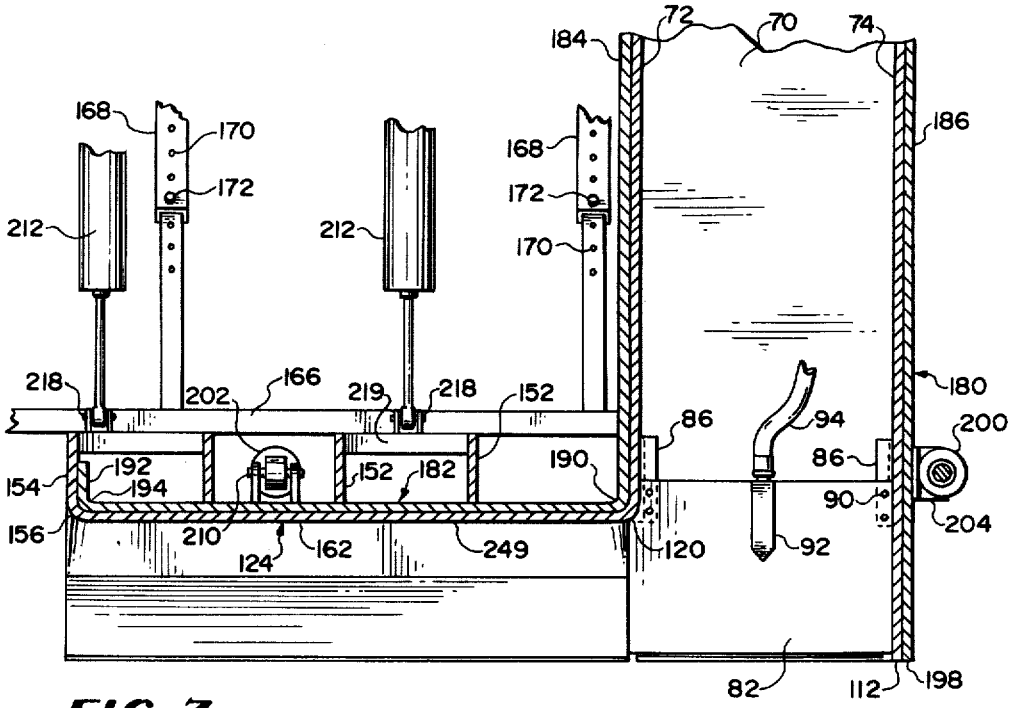
FIG. 3 is a fragmentary cross-sectional view taken along the lines 3—3 of FIG. 2.
Figure 6:
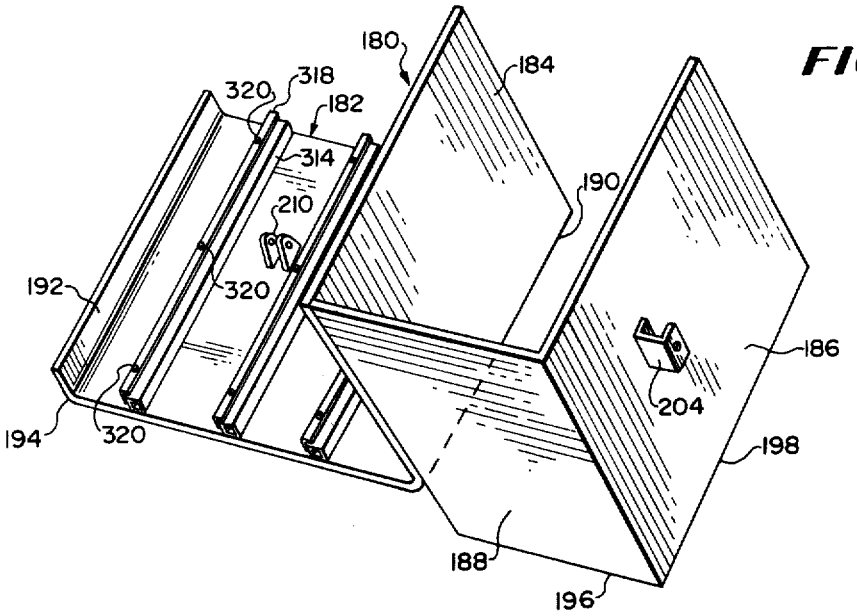
FIG. 6 is an elevational view of the adjustable skirt and hopper end wall combination.

To this end reference is made particularly to FIGS. 1, 3 and 6 wherein the adjustable skirt member 180 with the trailing integral slip form top wall or web 182 is shown to include the spaced side walls 184 and 186 and the end wall 188. The web 182 meets the wall 184 at the round corner 190 and terminates with the upturned end wall 192, with the rounded trailing corner 194. This adjustable skirt member and web fits upon the hopper 54 with the web 182 within the open-ended slots 160 and in sliding contact and resting upon the top surface 162 of the slip form 124 and with the rounded corners 190 and 194 inside the corners 156 and 120 in the manner best illustrated in FIG. 3. The bottom edge 196 of the end wall 188 and the bottom edge 198 of the front wall 186 are co-planar and comform with the bottom edges 112 of the inside wall 74 of the hopper. The end wall 192 is spaced under the tie beams 164 and 166. The walls 184 and 186 of the skirt member 180 encompass the outside of the walls 72 and 74 of the hopper 54 in sliding guided relationship. So positioned the adjustable wall 188 of skirt 180 replaces the end wall 177 shown in FIG. 4.

Means are provided to slide the skirt member 180 and the web 182 laterally upon the slip form 124 within the open-ended slots 160 and thus extend the effective width of the concrete slab 100 along the sloping grade 102. For this purpose the pair of dual-action rams 200 and 202 (FIGS. 1, 2, 3 and 11) are provided. The ram 200 is mounted between the wall 56 of the hopper 54 and the wall 186 of the skirt member 180 between the cleats 204 on the pivot pins 206, and controlled by the hydraulic hose lines 208. The ram 202 is mounted between similar pivot mounts 210, one on the top of the web 182 and the other on the top wall 126 of the slip form 124. The simultaneous operation of the rams 200 and 202 extends the hopper wall 186 and the web 182 in unison to spread a wider sloping layer of concrete 100 under the combined spreading and compacting action of the hopper, slipform and web. When such an adjustment is made the speed of delivery of the conveyor 66 can be simultaneously increased to deliver more concrete to the tool so that the portion of the hopper 54 between the weir plate 82 and the end wall 186 is adequately filled and compacted by a vibrator 92.

The tool so far described to include the hopper of FIG. 4 and the adjustable skirt member 184 and combined web 182 can be used to lay a concrete slab 100 that meets the specifications of a wide span of construction projects. However, the building of canals and ditches requires the machine to negotiate stretches of rough terrain and the dimensions of the ditch and its contours often requires further capabilities and functions of the tool and its suspension from the machine.

In order to provide auxillary force to adjust the slip form tool along the hinge line 97 and also impart a hold-down force upon the slip form during operation, the pair of dual-action rams 212 is provided, tied between the frame extension 50 and the slip form 124 by means of the pivotal cleats 214 at the top and the pivotal cleats 216 at the bottom, the latter cleats are attached at any convenient position, i.e., to the top inner edge of the end wall 154 as shown in FIG. 3 or to cross brace 219, that connects between a pair of the spacer plates 152 also best shown in FIG. 3. Alternatively, the rams 212 can be attached to either of the longitudinal braces 164 or 166 since these are tied to the slip form 124. The rams do not attach to the web 182 since this part slides transversely upon the top of the slip form. The rams 212 extend and retract simultaneously by means of the hydraulic control lines 220 connected to the hydraulic system of the machine 10. One ram, preferably centrally located can be used in place of the double rams 212. The rams 212 are operated with the pins or bolts 172 removed from the extendable braces 168. The function of the rams 212 can be under the control of a second grade reference extending along the bottom 104 of the ditch, to hold the tool at a predetermined height or slab thickness in relation to the slope as the machine controls the over-all direction grade and slope in relation to the grade reference 30. A separate sensor (not shown) would be attached to the inboard wall 186 of the skirt 180 of the hopper 54 so that its sensing arm can be adjacent the second string line which would extend along and coincident with the juncture 106 of the bottom 104 and the slope 102.

Figure 11:
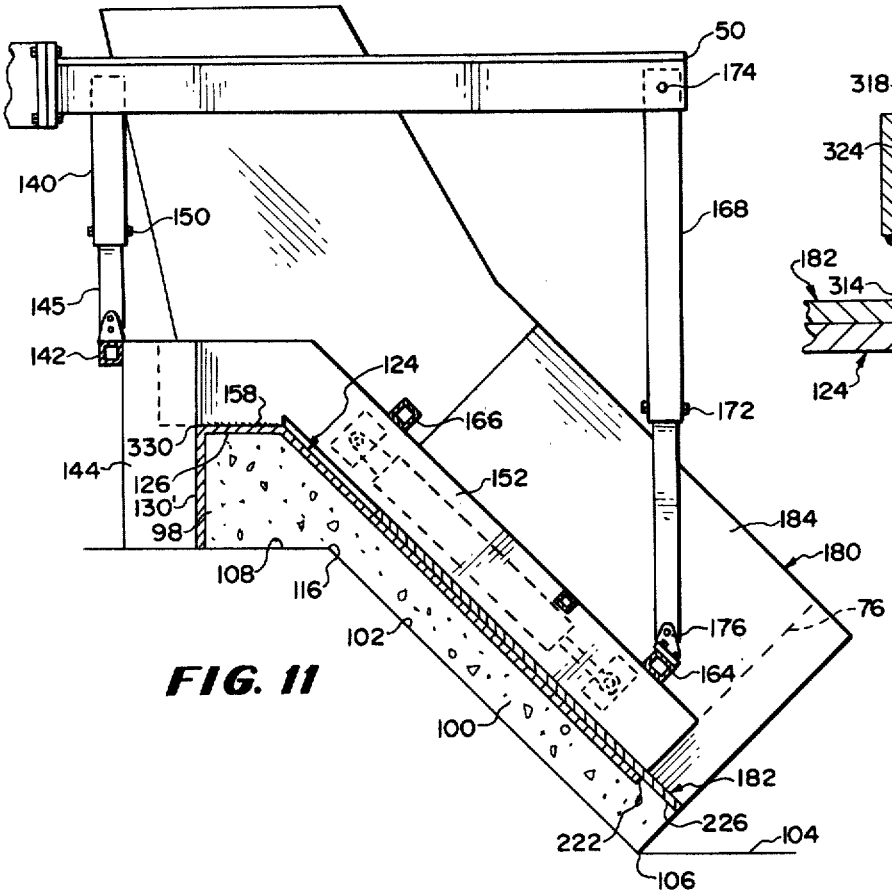
FIG. 11 is a fragmentary cross-sectional view taken along the lines 11—11 of FIG. 2.

It is apparent that in using the tool or slip form of this invention, as so far described, there will be an off-set in the finished slab at the corner junction 222 of the edges 224 (FIG. 4) of the slip form 124 and the bottom surface 226 of the web 182 (see FIG. 11). Also, because of the slope 102, any tendency for the concrete slab to move downward in the event the slump characteristics of the concrete 70 are not properly adjusted, i.e., too wet a concrete is used, means are provided to smooth out the offset and work the concrete upwardly on the slope, in the form of the trailing screed 230 (FIGS. 1, 2 and 12) which is supported on a pair of longitudinal tie beams 164 and 166 carried by the web 182 and the cross beam 232. The screed 230 best shown in FIGS. 2 and 12, has the flat bottom 234 with the upturned forward wall 236 and the upturned rear wall 238 joined thereto along the front rounded corner 240 and the rear rounded corner 242. The screed 230 is also provided with the top side wall 243 and the bottom side wall 245 so that there is no tendency for the concrete to flow over the top and it can float on the freshly laid slab 100.

Means are provided to impart several degrees of adjustment to the screed 230, to include means to pull the screed at an angle to the direction of travel, indicated by the arrow 246, of the machine 10; means to pivot the screed 230 along that inclined axis so that the plane of the bottom 234 can be parallel to or at a slight angle to the bottom 247 of the slip form 124; means to vary the hold-down pressure imparted on the screed; means to adjust the longitudinal alignment of the screed 230 with the machine and means to balance the screed fore and aft from its suspension point or points so that the angle of approach of the screed bottom 254 to the freshly laid slab coming from under the slip form is maintained for proper finishing action.

The screed 230 is provided with a pair of pulling cleats 248 attached to the inside of the front wall 236 that extend rearwardly and are rotatably attached to the draw bar 250 that extends across between and through the longitudinal supports 164 and 166. Instead of using a continuous bar, the cleats 248 can be suitably pivoted at the supports 164 and 166. Alternately, the cleats can be attached to the supports 164 and 166 and pivotally mounted at their other ends to the screed 230. By using an elongated draw bar 250, the pulling cleats 248 can be spaced therealong and from the insides of the supports 164 and 166 to provide for some axial movement of the screed 230 along the draw bar.

The screed 230 is held in a canted position aft of the slip form 124 so that the lower corner 252 (FIG. 2) is close to the trailing end or wall 154 of the slip form and offset 222 (which forms an edge in the slab to be removed); while the upper or inboard corner 254 is spaced from the other edge of the slip form as indicated at 256.

Figure 12:
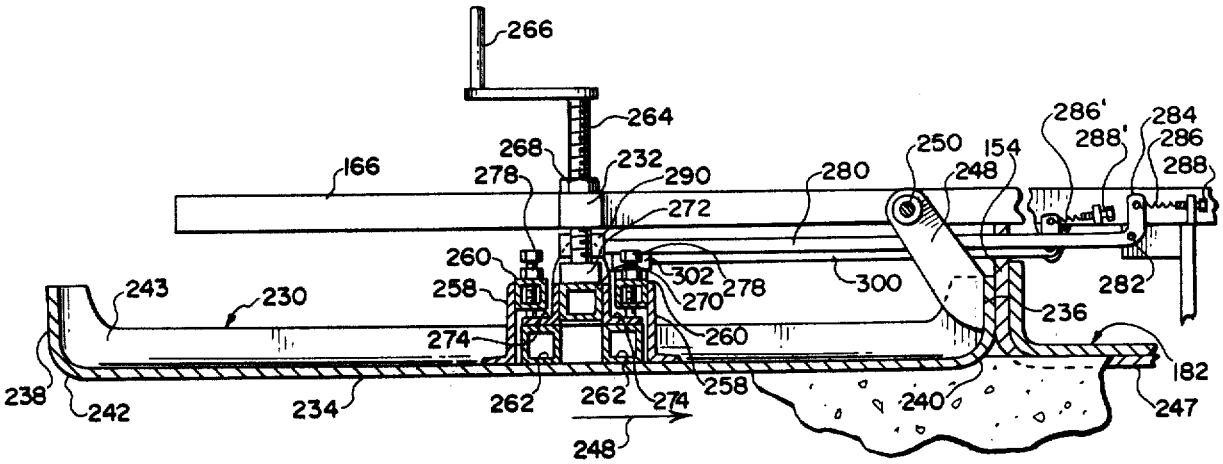
FIG. 12 is a fragmentary cross-sectional view taken along the lines 12—12 of FIG. 2.

Means to hold the screed 230 down in pressure contact with the concrete layer 100 and also provide for axial movement along the draw bar 250 are shown in FIG. 12 in the form of the opposing elongated angle irons 258 attached to the top surface of the screed plate and having the elongated opposing box flanges 260 on their inner edges and spaced above the screed plate. The screed also has the pair of box beams 262 attached to the top of the plate and spaced from the bottoms of the box flanges. These parts are carried by the screed and define inwardly facing, opposed channels as shown.

At a point substantially equidistant from the longitudinal beams 164 and 166, the cross beam 232 carries the extensible member 264 in the form of a threaded shank attached at the upper end to the crank 266 by means of the fixed threaded nut 268. The shank 264 is coupled to the cross beam 270 by means of the ball and socket mounting 272. The beam 270 has the pair of side flanges 274 that extend into the longitudinal channels between the bottoms of the box flanges 260 and the tops of the box beams 262. At least a pair of set screws 278 extend in threaded engagement through each of the box flanges 260 to impinge upon the flanges 274 and hold the box beam 270 thereto at selected laterally spaced locations. Thus, the attitude of the screed 230 can be adjusted sufficiently in both vertical and horizontal directions to accommodate the desired screed action.

A further floating action is imparted to the screed 230 about the ball and socket joint 272 by means of two pairs of crank arms that provide a biasing action to this mounting as well as a hold-down pressure. The first pair of crank arms 280 is pivoted at the pins 282 on the inside of each longitudinal beam 164 and 166. One end of these crank arms, as at 284, is connected to the strong spring 286 and the springs are attached to the beams 164 and 166 by the adjusting screws 288 for the purpose of varying the bias. The other ends of the first pair of crank arms 280 are each attached to the box beam 270 at the pivot mounts 290. It is seen that the bias of the springs 286 holds the screed 230 upwardly at about its geometric center above the socket or swivel mounting 272. By adjusting the tensioning screws 288 the weight of the screed acting on the mount 64 is adjusted.

The second pair of crank arms 300 are similarly mounted to the longitudinal supports 164 and 166, to include the adjustable biasing springs 286' and set screws 288'. However, at their rearward ends these crank arms 300 are pivotally mounted to the forward part of the box beam, i.e., ahead of the pivot 290 and ahead of the central pivot 272, as at the pivot 302. The crank arms 300 and the springs 286' at their forward ends tend to cant the screed 230 so that the front rounded corner 240 is slightly lower or higher than the rear rounded corner 242 or these parts are in the same plane. By these means the necessity for vibrating the screed 230 is eliminated.

For many ditch side wall slip forming operations no other guiding means than the guide plates 152 and the slots 160 need be used for the slip form 230. However, because of the wear of these parts due to the adverse conditions under which they must operate and also because considerable upward pressure on the web or skirt 182 is experienced in its extended position, auxillary stiffening and holding means are provided which also function to lock the skirt 182 and hopper end wall 186 in a desired position for average work not requiring continuous adjustment as might be encountered with a poorly prepared grade.

Figure 10:
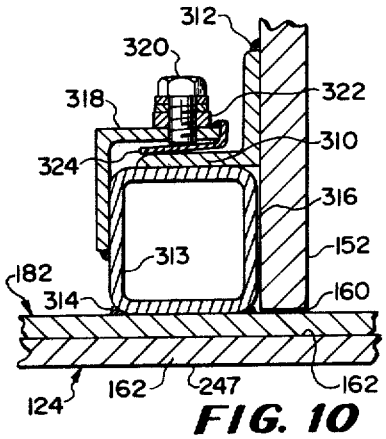
FIG. 10 is a fragmentary cross-sectional view taken along the lines 10—10 of FIG. 2.

Such auxillary means is shown in more detail in FIGS. 1 and 10. The guide plate 152 has the angle iron 310 welded to the side at 312 and the web 182 carries the box beam 313 welded at 314 and spaced on the inside from the guide plate 152 as shown at 316. The box beam 313 has the upper flange 318 that defines therewith a channel that extends over the flange 310 in spaced relationship. A plurality of set screws 320 with lock nuts 322 are spaced along the flange 318, retaining the combined wear plates and tensioning means 324 for resilient contact with the top of the flange 310. Tightening of the set screws 320 pulls the box beam 314 against the under side of the flange 310 within the limits of the open ended slot 160.

In order to move the machine of this invention from one working area to another it is merely necessary to remove the pins 150 and 172 from the supports 140 and 168 and retract the rams 212. This raises the entire hopper and tool within the limits of these telescoping parts so that the tool clears the ground during movement.

From the foregoing description, it is apparent that a number of modifications can be made in the tool set forth. The hinge line 97 and the series of hinges 132 and 134 can be omitted. This is shown in FIG. 11 where the modified moldboard or wall 130' is constructed integral with the top wall 126 of the slip form plate 124 forming the fixed corner 330. It is also apparent that for some construction jobs, the reinforcing plates 144 can be omitted and the longitudinal support member 142 can be attached to the guide plates 152 and the end wall 154.

Referring to FIG. 12, the cleats 248 can have rearward extensions presenting a series of longitudinally spaced bore holes for attachment of the draw bar 250 so that the trailing distance of the screed 230 can be varied. The levers 280 and 300 can telescope to accommodate this adjustment.

The pivot point 272 has been described as being at or near to the geometric center of the screed member 230. This assumes that the screed member 230 is of uniform construction so that the geometric center is coincident with the center of gravity of the assembly to enhance the floating action of the screed 230. Where the center of gravity is spaced from the geometric center, the former would be used as this pivotal point of attachment. Likewise, the transverse line on which the pivots 290 for the trailing crank arms 280 are mounted will be changed to intersect the center of gravity. The distance forward of the central pivot 272 at which the down pressure cranks 300 are attached by means of the pivot points 302 can be varied as well as the lengths of the upright arms 284 of the cranks to increase or decrease the mechanical advantage of this resilient linkage mount for the trailing screed 230.

An advantage of the arrangement shown is the facility with which the concrete slab 100 can be laid on a slope 102 and grade 32 while still meeting the most rigid specifications for this kind of paving. This is in part due to the combined smoothing and up-grading action of the screed 230 and in turn related to its canted trailing position immediately behind the slip form. The angular relationship of the rounded front edge 240 works the concrete upwardly along the slope 102 while at the same time taking out the small offset created by the juncture 222. The screed plate 124 can be constructed of relatively thin material since it is reinforced by the web plate 182 thereof, thus minimizing the offset 222 when wider slopes 102 are encountered. Both curves and grade changes are readily negotiated by the tool of this invention since it is relatively short longitudinally and the longitudinal pivot or hinge line 97 allows for some adjustment when encountering these changes in the graded ditch. The front walls 186 and 56 can be slotted at their off-lapping positions for the introduction of reinforcing mesh as desired.

The ditch paving tool of this invention is adapted to form a continuous layer of concrete along the sloping wall and top birm of a graded ditch upon being propelled by any type of prime mover equipped with grade and slope control. The open-bottomed hopper for the concrete is defined by front and rear spaced essentially vertical walls, an inside wall over the birm and the fixed outside wall 177 or the adjustable wall 188. The front wall of the hopper has its bottom edge contoured to correspond to the graded slope of the ditch and the bottom edge of the rear wall is offset above the contour of the bottom edge of the front wall to define the contour and thickness of the top surface of the concrete layer.

The hopper and the slip form communicating with it are integral and move together. The juncture of the slip form wall and the rear wall of the hopper is contoured to the desired shape of the top surface of the concrete layer which may be the same as the contour of the grade or, in some instances, may have a different contour. The invention provides means for extending the effective width of both the hopper and the slip form by providing the outer wall of the hopper with inwardly directed side walls that overlap the side walls of the main hopper and act as guides for this adjustment. The side walls of the extendable part of the hopper are integral with a top web riding on the slip form and under manual or automatic control through the extensible members.

This adjustable function allows the operator to control the position of the outer lower edge of the concrete slab and keep it contiguous with the bottom edge of the ditch. A screed is also provided which is suspended or floated upon the freshly laid slab behind the slip form by a resilient suspension means, capable of varying the longitudinal angle of the flat screed bottom, the contact pressure and the angle of approach of the front rounded screed edge to the sloped side wall of the slab. The inside of the tool can have a longitudinal side or moldboard that supports the tool along a hinge line at its top edge. Extensible means are provided to pivot the entire tool along this hinge line and thus finitely control the thickness of the slab at the juncture of the birm and the slope, accommodate variations in the grade of the ditch bottom and raise the tool for transport.

What is claimed is:

1. A ditch paving tool adapted to form a continuous layer of concrete along a sloping wall and top birm of a graded ditch upon being propelled therealong by a prime mover comprising:

an open-bottomed hopper for said concrete including front and rear spaced walls, an inside wall defining the edge of said concrete layer over said birm and an outside wall defining the edge of said concrete along the bottom of said sloping wall of said ditch;

said front wall of said hopper having its bottom edge contoured to correspond to said graded ditch and birm;

the bottom edge of said rear wall being offset above the contour of the bottom edge of said front wall to define the contour of the top surface of said concrete layer; and said rear wall including an integral slip form means comprising a rearwardly extending plate conforming longitudinally to the contour of said bottom edge of said rear wall and having a second inside wall coextensive with the inside wall of said hopper defining the edge of said concrete layer over said birm.

2. A ditch paving tool in accordance with claim 1 in which:

said outside wall of said hopper is a separate movable wall having a pair of side walls attached to the front and rear edges and extending on the outsides of and in sliding contact with the front and rear walls of said hopper;

one of said sliding side walls being adjacent said front wall of said hopper and having its bottom edge substantially in the plane of the bottom edge of said front wall of said hopper;

the second of said sliding side walls being adjacent said rear wall of said hopper and having its bottom edge in sliding relationship over the rearwardly extending plate of said slip form;

a web wall extending rearwardly of the bottom edge of said second sliding side wall of said hopper with its under surface also in sliding relationship over the top of said rearwardly extending plate of said slip form; and means to simultaneously extend and retract said separate movable wall, said pair of side walls and said web wall in relation to said hopper and slip form whereby the effective width of said layer of concrete is made to conform with the width of the sloping wall of said ditch.

3. A ditch paving tool in accordance with claim 2 including:

hold-down means to retain said web wall in said sliding relationship upon said rearwardly extending plate of said slip form under the pressure of concrete thereunder.

4. A ditch paving tool in accordance with claim 3 in which:

said hold-down means comprises a transverse plate member affixed normal to the top of said slip form and defining along its lower edge an enlongated open-ended slot to receive said web wall in sliding relationship.

5. A ditch paving tool in accordance with claim 1 in which:

the bottom edge of said bottom wall of said hopper and said second inside wall of said slip form define a moldboard extending along the top edge of said concrete layer;

said moldboard being hinged to said inside wall of said hopper and hinged to said slip form along a common longitudinal hinge line;

means to support said moldboard in a substantially vertical plane from said prime mover; and adjustable means to pivot said hopper and slip form along said hinge line in relation to said moldboard and support means.

6. A ditch paving tool in accordance with claim 2 including:

a pan-shaped screed member trailing the rear end of said slip form and having a transverse width about equal to the width of said slip form along said sloping wall;

said screed member having a rounded front edge extending transverse and at an angle to the rear end of said slip form, said angle opening toward the top of the sloping wall of said ditch; and means to resiliently suspend said screed member behind said slip form in pressure contact with said concrete layer being formed.

7. A ditch paving tool in accordance with claim 6 in which:

said resilient suspension means comprises:

a first pivot means adapted to allow said screed member to pivot along an axis parallel to said rounded front edge;

a second pivot means attached to the top of said screed member at about its geometric center; and a first resilient means biasing said screed member upwardly against said pivot means transverse said geometric center; and a second resilient means biasing said screed member downwardly forward of said geometric center.

8. A ditch paving tool in accordance with claim 7 in which:

said first resilient biasing means comprises a pair of longitudinal trailing and transversely spaced crank arms pivotally mounted from said slip form;

the trailing ends of each of said crank arms being pivotally mounted to said screed member at points transverse its geometric center;

the other ends of said crank arms being attached to spring means urging said crank arms about said pivotal mountings to apply an upward force against each of said pivotal mountings and in which:

said second resilient biasing means comprises a second pair of longitudinal trailing and transversely spaced crank arms pivotally mounted from said slip form;

the trailing ends of each of said second crank arms being pivotally mounted at transverse points forward of said geometric center of said screed member;

the other ends of said second pair of crank arms being attached to spring means urging said crank arms about their pivotal mountings to apply a downward force on said screed member ahead of its geometric center.

9. A ditch paving tool in accordance with claim 6 in combination with a side frame of said prime mover to suspend and transport said tool along the sloping side wall of said ditch in which:

said resilient suspension means includes a vertical extensible member attached between said side frame and said geometric center of said screed member; and means to extend and retract said extensible member whereby the hold-down pressure of said resilient suspension means is variable.

10. A ditch paving tool adapted for attachment to the side frame of a prime mover to be transported thereby to form a continuous layer of concrete along a sloping wall and top birm of a graded ditch comprising:

an open-bottomed hopper for said concrete including front and rear spaced walls, an inside wall defining the edge of said concrete layer over said birm and a transversely adjustable outside wall defining the edge of said concrete along the bottom of said sloping wall of said ditch;

the front wall of said hopper having its bottom edge contoured to said graded ditch and birm;

the bottom edge of said rear wall being offset above the contour of the bottom edge of said front wall to define the contour of the top surface of said concrete layer;

said rear wall including an integral slip form means comprising a rearwardly extending flat plate conforming longitudinally to the contour of said bottom edge of said rear wall and having a second inside wall coextensive with the inside wall of said hopper defining the edge of said concrete layer over said birms;

said adjustable outside wall of said hopper having a pair of side walls attached to the front and rear edges and extending on the outsides of and in sliding contact with the front and rear walls of said hopper;

one of said sliding walls being adjacent said front wall of said hopper and having its bottom edge substantially on the plane of the bottom edge of said front wall of said hopper;

the second of said side walls being adjacent said rear wall of said hopper and having its bottom edge in sliding relationship over the rearwardly extending plate of said slip form;

a web wall extending rearwardly of the bottom edge of said second sliding side wall of said hopper with its under surface also in sliding relationship over the top of said rearwardly extending plate of said slip form and defining therewith a longitudinal offset on the under surfaces;

hold-down means to retain said web wall in said sliding relationship uon said rearwardly extending plate of said slip form under pressure of concrete thereunder;

a pan-shaped screed member trailing the rear end of said slip form and having a transverse width about equal to the width of said slip form along said sloping wall;

said screed member having a rounded front edge extending transverse and at an angle to the rear end of said slip form, said angle opening toward the top of the sloping wall of said ditch; and means to resiliently suspend said screed member behind said slip form in pressure contact with said concrete layer being formed and with its lower trailing corner over said off-set whereby to form a flat top surface in said concrete layer.

* * * * *

UNITED STATES PATENT AND TRADEMARK OFFICE

CERTIFICATE OF CORRECTION

PATENT NO. : 3,936,211

DATED : February 3, 1976

INVENTOR(S) : DAVID J. MILLER and CHARLES P. MILLER

It is certified that error appears in the above-identified patent and that said Letters Patent are hereby corrected as shown below:

Column 1, line 53, after "end wall" delete ----- as well ----;

Column 8, line 18, after "bottom" delete "254" and insert --- 234 ---;

Column 9, line 16, after "mount" delete "64" and insert --- 272 ---; and

Column 14, line 32, after "relationship" delete "uon" and insert --- upon ---.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*